US008994767B1

(12) United States Patent
Liao

(10) Patent No.: US 8,994,767 B1
(45) Date of Patent: Mar. 31, 2015

(54) PRINTING DEVICE WITH DUPLEX PRINTING FUNCTION

(71) Applicant: HiTi Digital, Inc., New Taipei (TW)

(72) Inventor: Ku-Feng Liao, Taichung (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 0 days.

(21) Appl. No.: 14/339,448

(22) Filed: Jul. 23, 2014

(30) Foreign Application Priority Data

May 26, 2014 (TW) ..... 103118296 A

(51) Int. Cl.
*B41J 3/60* (2006.01)
*B41J 11/70* (2006.01)
*B41J 13/00* (2006.01)

(52) U.S. Cl.
CPC .. *B41J 11/70* (2013.01); *B41J 3/60* (2013.01); *B41J 13/0045* (2013.01)
USPC ..... 347/218

(58) Field of Classification Search
USPC ..... 347/171, 172, 174, 176
See application file for complete search history.

(56) References Cited

U.S. PATENT DOCUMENTS 8,042,931 B2 * 10/2011 Hiroki et al. ..... 347/104
8,599,229 B1 12/2013 Mindler et al.
8,599,230 B1 * 12/2013 Mindler et al. ..... 347/174
8,913,095 B2 * 12/2014 Mindler et al. ..... 347/174

* cited by examiner

*Primary Examiner* — Huan Tran
(74) *Attorney, Agent, or Firm* — Winston Hsu; Scott Margo

(57) ABSTRACT

A printing device includes a print head, a paper roll, a first paper path, a second paper path, a third paper path, a cutting mechanism and a fourth paper path. The paper roll is for rolling a printing media. The first paper path has a first end and a second end, and the first end is connected to the paper roll. The second paper path is connected to the second end and oriented reverse to the first paper path for being connected to the print head. The third paper path extends from the second end. The cutting mechanism is disposed on the third paper path and for cutting the printing media into a media sheet. The fourth paper path connects the third paper path and the second paper path.

20 Claims, 13 Drawing Sheets

PRINTING DEVICE WITH DUPLEX PRINTING FUNCTION

BACKGROUND OF THE INVENTION

1. Field of the Invention

The present invention relates to a printing device, and more particularly, to a printing device with duplex printing function.

2. Description of the Prior Art

Generally speaking, a printing device (e.g. a printer) is used for printing texts or patterns onto a printing media (e.g. paper). When a duplex printing for the printing media is required, it needs to manually turn the printing media with one side been printed over, so as to print the opposite side of the media. However, when an amount of the printing media with the duplex requirement increases, it results in increase of labor time due to turning operation for the printing media, leading to inconvenience in operation.

SUMMARY OF THE INVENTION

Thus, the present invention provides a printing device with duplex printing function for solving above drawbacks.

According to an embodiment of the present invention, a printing device with duplex printing function includes a print head, a paper roll, a first paper path, a second paper path, a third paper path, a cutting mechanism and a fourth paper path. The paper roll is for rolling a printing media. The first paper path has a first end and a second end, and the first end is connected to the paper roll. The second paper path is connected to the second end of the first paper path and oriented reverse to the first paper path for being connected to the print head. The second paper path is for turning a bottom surface of the printing media to face the print head when the printing media is fed to the print head via the first paper path and the second paper path. The third paper path extends from the second end of the first paper path. The cutting mechanism is disposed on the third paper path. The cutting mechanism is for cutting the printing media into a printing sheet when the printing media is fed into the third paper path via the first paper path. The fourth paper path connects the third paper path and the second paper path, such that the printing sheet is fed from the third paper path into the second paper path via the fourth paper path, so as to be fed to the print head with a top surface opposite to the bottom surface of the printing sheet facing the print head.

According to another embodiment of the present invention, the printing device further includes a feeding mechanism coupled to the paper roll. The feeding mechanism is for driving the paper roll to rotate, so as to feed the printing media into the first paper path along a first direction or to feed the printing media out of the first paper path along a second direction opposite to the first direction.

According to another embodiment of the present invention, the feeding mechanism includes a first actuating member, an actuating gear, a first gear, a second gear, a third gear, a fourth gear, a fifth gear and a sixth gear. The actuating gear is combined with the first actuating member. The first gear has a first tooth portion and a second tooth portion, and the first tooth portion engages with the actuating gear. The second gear engages with the second tooth portion. The third gear is coupled to the second gear. The fourth gear is combined with the paper roll and engages with the third gear. The fifth gear engages with the fourth gear. The sixth gear engages with the fifth gear.

According to another embodiment of the present invention, the printing device further includes a feeding roller set coupled to the feeding mechanism and for moving the printing media along the first direction or along the second direction.

According to another embodiment of the present invention, the feeding roller set includes a feeding active roller and a feeding idle roller. The feeding idle roller rotably abuts against the feeding active roller. The feeding active roller and the feeding idle roller are cooperatively for moving the printing media.

According to another embodiment of the present invention, the printing device further includes a first guiding gate mechanism disposed on the second end of the first paper path and for selectively communicating the first paper path with the second paper path or with the third paper path.

According to another embodiment of the present invention, the printing device further includes a second guiding gate mechanism disposed on a conjunction where the third paper path is connected to the fourth paper path and for selectively communicating the third paper path with the fourth paper path.

According to another embodiment of the present invention, the printing device further includes a first paper head sensor disposed within the first paper path and for sensing a paper head of the printing media.

According to another embodiment of the present invention, the printing device further includes a second paper head sensor disposed within the third paper path and for sensing the paper head of the printing media, wherein a path length of the third paper path between the second paper head sensor and the cutting mechanism is substantially equal to a first paper length.

According to another embodiment of the present invention, the printing device further includes a third paper head sensor disposed within the third paper path and for sensing the paper head of the printing media, wherein a path length of the third paper path between the third paper head sensor and the cutting mechanism is substantially equal to a second paper length, and the second paper length is greater than the first paper length.

According to another embodiment of the present invention, the printing device further includes a paper end sensor disposed within the third paper path and for sensing a paper end opposite to the paper head of the printing sheet.

According to another embodiment of the present invention, the printing device further includes a first roller set disposed within the third paper path and for moving the printing media or the printing sheet along the third paper path.

According to another embodiment of the present invention, the first roller set includes a first active roller and a first idle roller. The first idle roller rotably abuts against the first active roller. The first active roller and the first idle roller are cooperatively for moving the printing media or the printing sheet.

According to another embodiment of the present invention, the printing device further includes a second roller set disposed within the fourth paper path and for moving the printing sheet along the fourth paper path.

According to another embodiment of the present invention, the second roller set includes a second active roller and a second idle roller. The second idle roller rotably abuts against the second active roller. The second active roller and the second idle roller are cooperatively for moving the printing media or the printing sheet.

According to another embodiment of the present invention, the printing device further includes a roller transmission mechanism coupled to the first roller set and the second roller set. The roller transmission mechanism is for driving the first roller set and the second roller set to rotate.

According to another embodiment of the present invention, the roller transmission mechanism includes a second actuating member, an actuating pulley, a first step wheel, a second step wheel, a third step wheel, a fourth step wheel, a seventh gear, an eighth gear, a ninth gear, a pulley, a first belt, a second belt and a third belt. The actuating pulley is combined with the second actuating member. The first step wheel has a first gear portion and a first pulley portion. The second step wheel has a second gear portion and a second pulley portion. The third step wheel is coupled to the second active roller, and the third step wheel has a third gear portion and a third pulley portion. The fourth step wheel has a fourth gear portion and a fourth pulley portion. The eighth gear is engaging with the seventh gear and the first gear portion. The ninth gear engages with the second gear portion of the second step wheel and the third gear portion of the third step wheel. The first belt connects the actuating pulley and the pulley. The second belt connects the first pulley portion of the first step wheel and the second pulley portion of the second step wheel. The third belt connects the third pulley portion of the third step wheel and the fourth pulley portion of the fourth step wheel.

According to another embodiment of the present invention, the printing device further includes a printing roller set coupled to the roller transmission mechanism and for moving the printing media or the printing sheet to the print head.

According to another embodiment of the present invention, the printing roller set includes a printing active roller and a printing idle roller. The printing idle roller rotably abuts against the printing active roller. The printing active roller and the printing idle roller are cooperatively for moving the printing media or the printing sheet.

According to another embodiment of the present invention, e printing device further includes a printing roller set disposed within the second paper path and located in a position near the print head. The printing roller set is for moving the printing media or the printing sheet to the print head.

In summary, the present invention utilizes the second paper path to turn the bottom surface of the printing media to face the print head when the printing media is fed, such that the print head is able to perform printing operation on the bottom surface of the printing media. The present invention further utilizes the cutting mechanism to cut the printing media within the third paper path into the printing sheet. Then, the printing sheet is fed into the second paper path via the fourth paper path, and further fed to the print head via the second paper path, such that the print head is able to perform printing operation on the top surface of the printing sheet. In such a manner, the present invention can perform duplex printing operation, so as to decrease labor time and enhance convenience in operation.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
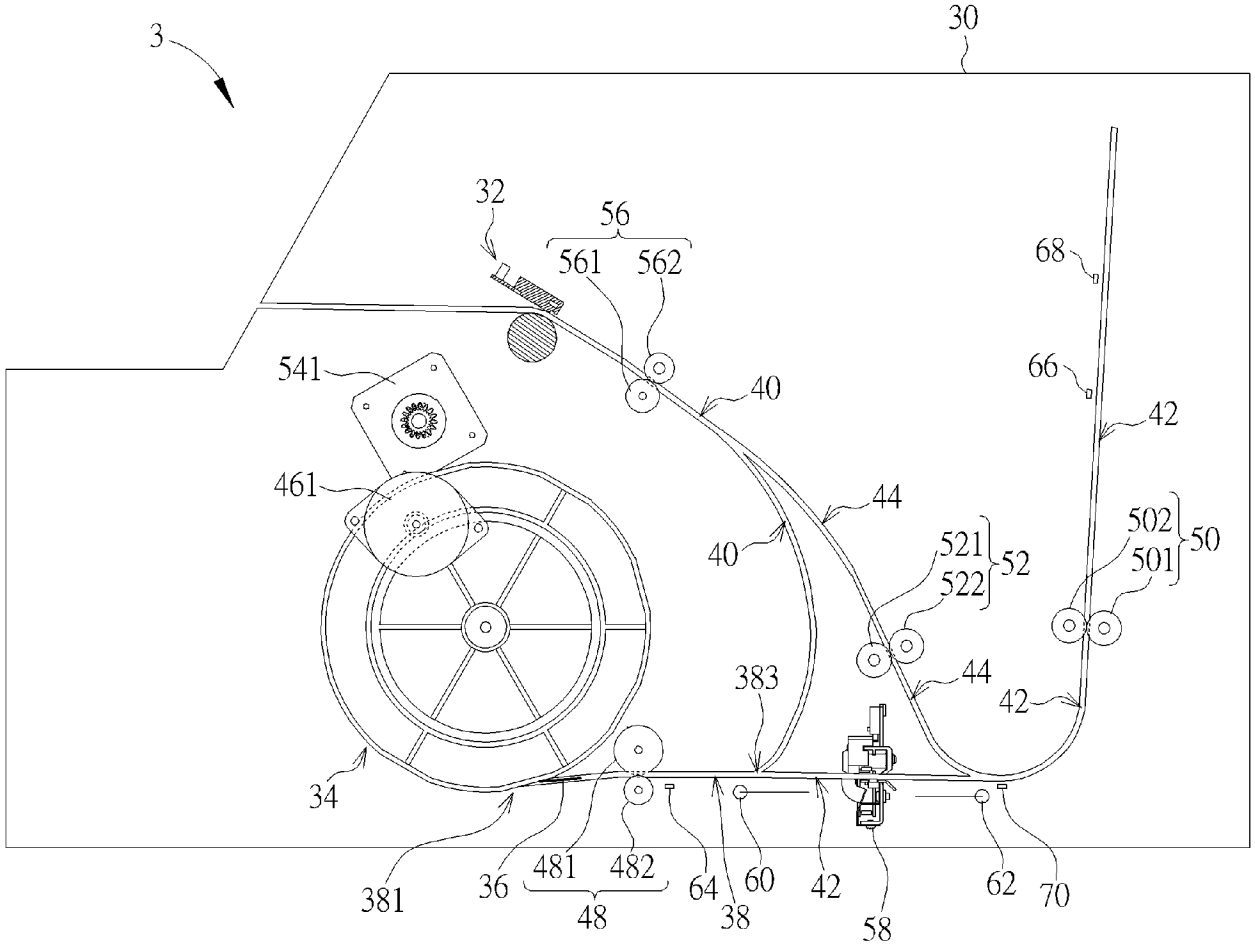
FIG. 1 is an internal diagram of a printing device according to an embodiment of the present invention.

Please refer to FIG. 1. FIG. 1 is an internal diagram of a printing device 3 according to an embodiment of the present invention. The printing device 3 includes a casing 30, a print head 32 and a paper roll 34. The print head 32 and the paper roll 34 are both disposed inside the casing 30. The paper roll 34 is for rolling a printing media 36, so as to enable the print head 32 print texts, patterns and so on onto the printing media 36. In this embodiment, the printing device 3 is a thermal printer, and the print head 32 is a thermal print head of the thermal printer.

Furthermore, the printing device 3 further includes a first paper path 38, a second paper path 40, a third paper path 42 and a fourth paper path 44. The first paper path 38 has a first end 381 and a second end 383 opposite to the first end 381, and the first end 381 is connected to the paper roll 34. The second paper path 40 is connected to the second end 383 of the first paper path 38 and oriented reverse to the first paper path 38 for being connected to the print head 32. The third paper path 42 extends from the second end 383 of the first paper path 38. The fourth paper path 44 connects the third paper path 42 and the second paper path 40. In practical application, the first paper path 38, the second paper path 40, the third paper path 42 and the fourth paper path 44 are formed by ribs on internal components which is disposed inside the casing 30, such as housing, plate and so on.

Figure 2:
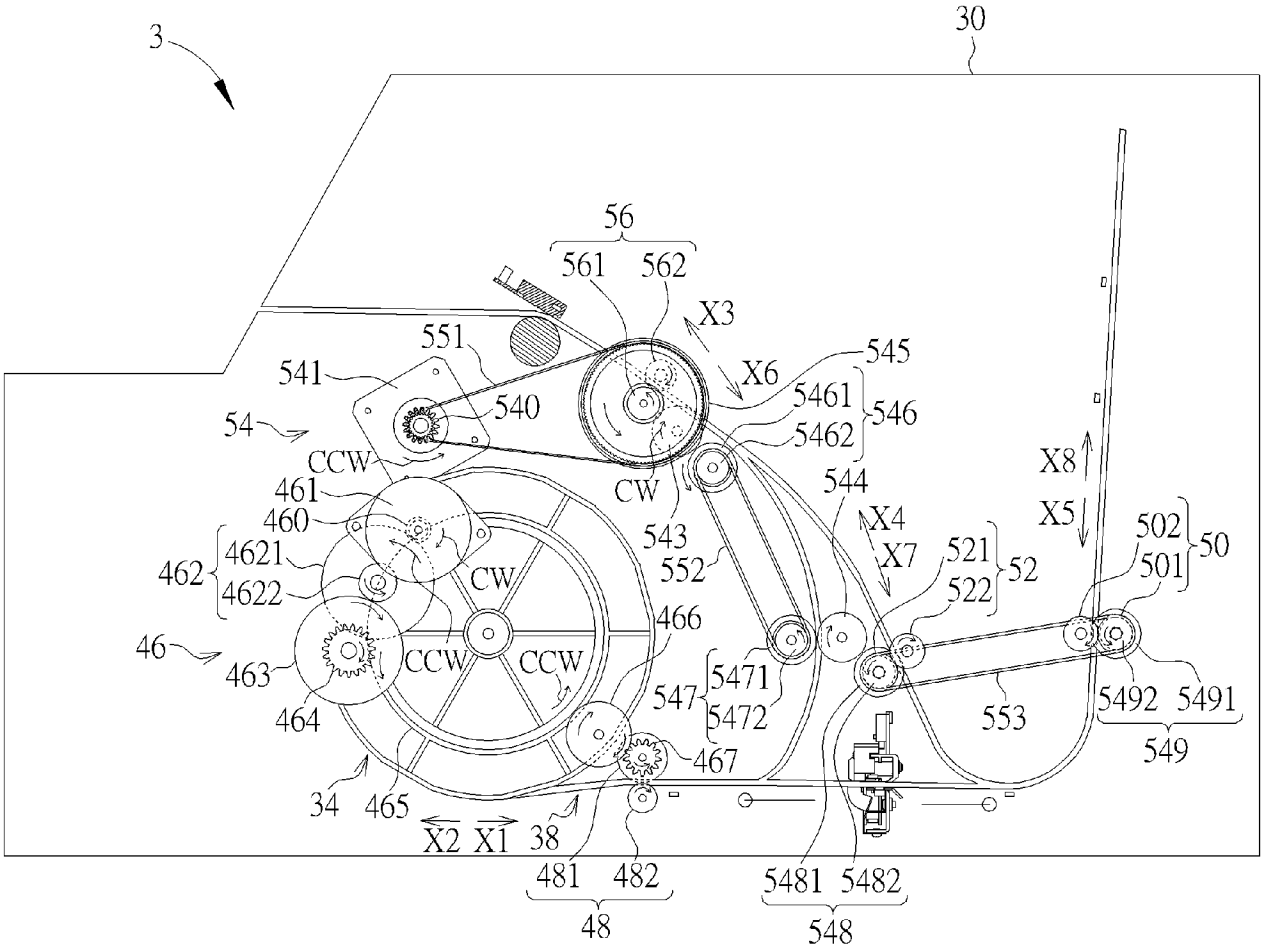
FIG. 2 and FIG. 3 are internal transmission diagrams of the printing device according to the embodiment of the present invention.
Figure 3:
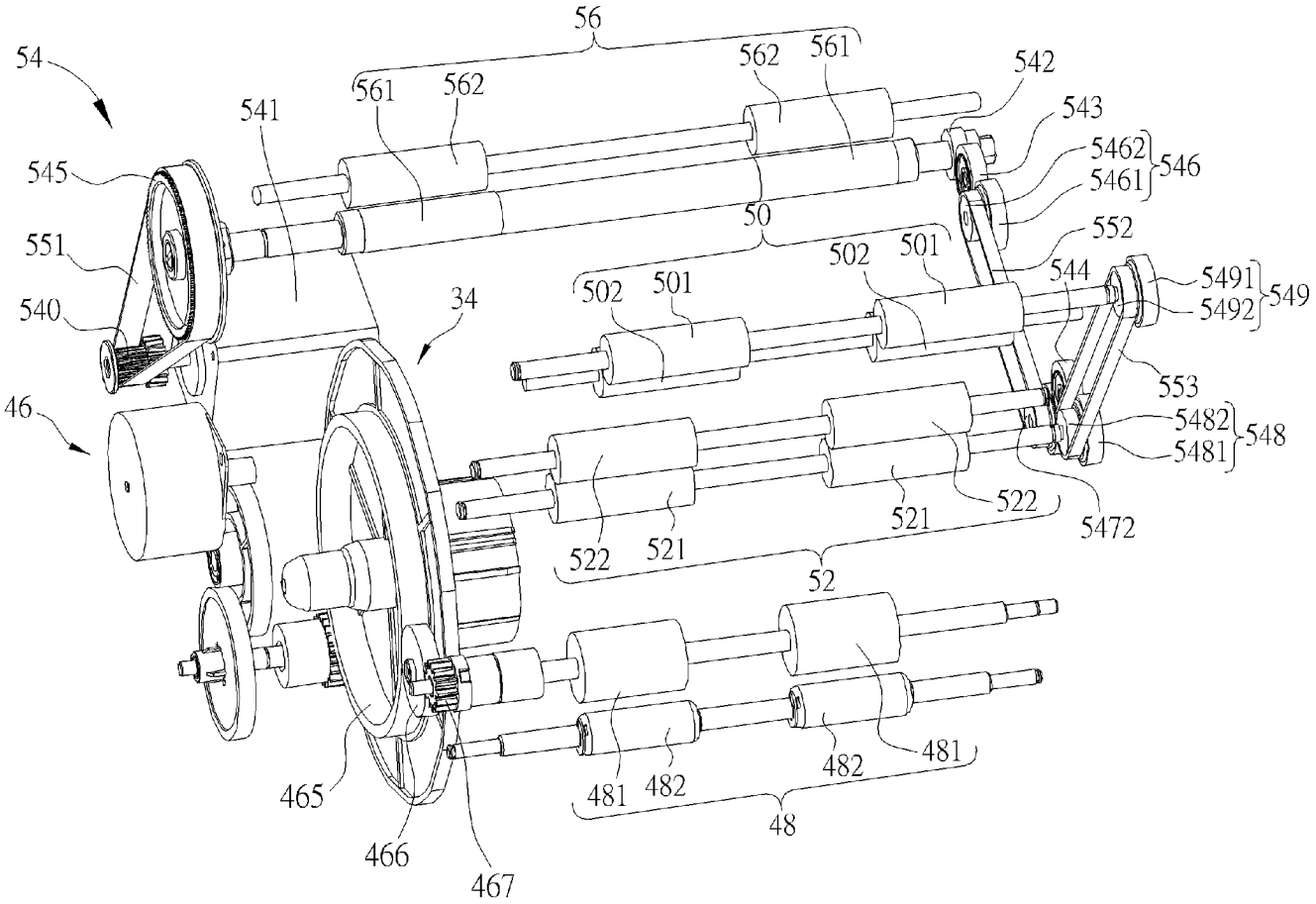
Figure 4:
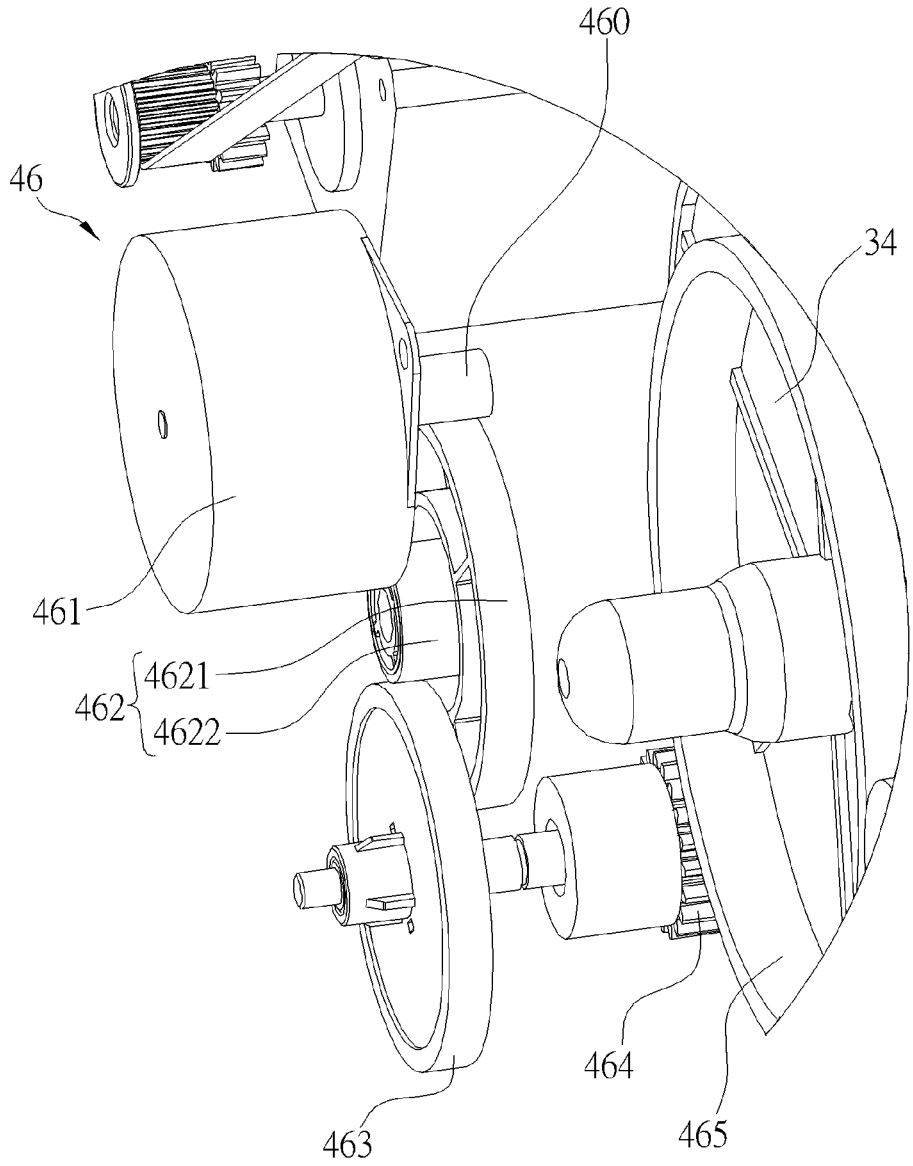
FIG. 4 is a partly diagram of a feeding mechanism shown in FIG. 3.

Please refer to FIG. 2 and FIG. 3. FIG. 2 and FIG. 3 are internal transmission diagrams of the printing device 3 according to the embodiment of the present invention. The printing device 3 further includes a feeding mechanism 46 and a feeding roller set 48. The feeding mechanism 46 is coupled to the paper roll 34, and the feeding roller set 48 is coupled to the feeding mechanism 46. Furthermore, the feeding roller set 48 includes a feeding active roller 481 and a feeding idle roller 482. The feeding idle roller 482 rotably abuts against the feeding active roller 481. Please refer to FIG. 2 to FIG. 4. FIG. 4 is a partly diagram of the feeding mechanism 46 shown in FIG. 3. The feeding mechanism 46 includes an actuating gear 460, a first actuating member 461, a first gear 462, a second gear 463, a third gear 464, a fourth gear 465, a fifth gear 466 and a sixth gear 467. The first gear 462 has a first tooth portion 4621 and a second tooth portion 4622. The actuating gear 460 is combined with the first actuating member 461. The first actuating member 461 is used for driving the actuating gear 460 to rotate. The actuating gear 460 engages with the first tooth portion 4621 of the first gear 462, and the second gear 463 engages with the second tooth portion 4622 of the first gear 462. The third gear 464 is coupled to the second gear 463. In this embodiment, the third gear 464 is coupled to the second gear 463 by a shaft, but the present invention is not limited thereto. For example, the third gear 464 and the second gear 463 can be integrally formed as well. The fourth gear 465 is combined with the paper roll 34 and engages with the third gear 464 and the fifth gear 466. The sixth gear 467 is coupled to the feeding active roller 481 and engages with the fifth gear 466.

As shown in FIG. 2, when the first actuating member 461 drives the actuating gear 460 to rotate in a clockwise direction CW, the actuating gear 460 activates the first tooth portion 4621 of the first gear 462 for driving the first gear 462 to rotate in a counterclockwise direction CCW opposite to the clockwise direction CW. Then, the second tooth portion 4622 of the first gear 462 activates the second gear 463 to rotate in the clockwise direction CW. Since the third gear 464 is coupled to the second gear 463, the third gear 464 activates with the second gear 463 simultaneously and rotates in the clockwise direction CW. Accordingly, the third gear 464 is capable of activating the fourth gear 465 to rotate in the counterclockwise direction CCW. Since the fourth gear 465 is combined with the paper roll 34, the paper roll 34 activates with the fourth gear 465 simultaneously and rotates in the counterclockwise direction CCW, so as to feed the printing media 36 into the first paper path 38 along a first direction X1. In other words, when the first actuating member 461 drives the actuating gear 460 to rotate in the clockwise direction CW, the first actuating member 461 is capable of driving the paper roll 34 to rotate in the counterclockwise direction CCW by the feeding mechanism 46, so as to feed the printing media 36 into the first paper path 38 along the first direction X1.

Furthermore, when the paper roll 34 rotates in the counterclockwise direction CCW, the fourth gear 465 activates the fifth gear 466 to rotate in the clockwise direction CW. Then, the fifth gear 466 activates the sixth gear 467 to rotate in the counterclockwise direction CCW. Since the sixth gear 467 is coupled to the feeding active roller 481, the feeding active roller 481 activates with the fifth gear 466 simultaneously and rotates in the counterclockwise direction CCW, and the feeding active roller 481 further activates the feeding idle roller 482 to rotate reversely. Thus, when the first actuating member 461 drives the paper roll 34 to feed the printing media 36 to the feeding roller set 48 along the first direction X1, the feeding active roller 481 and the feeding idle roller 482 of the feeding roller set 48 can respectively clamp a top surface 361 and a bottom surface 363 of the printing media 36 for moving the printing media 36 along the first direction X1.

In summary, when the first actuating member 461 drives the actuating gear 460 to rotate in the clockwise direction CW, the feeding mechanism 46 is used for activating the paper roll 34 to rotate together with the feeding active roller 481, so as to move the printing media 36 along the first direction X1. Similarly, when the first actuating member 461 drives the actuating gear 460 to rotate in the counterclockwise direction CCW opposite to the clockwise direction CW, the feeding mechanism 46 is used for activating the paper roll 34 to rotate together with the feeding active roller 481, so as to move the printing media 36 out of the first paper path 38 along the second direction opposite to the first direction X1.

As shown in FIG. 1 to FIG. 4, the printing device 3 further includes a first roller set 50, a second roller set 52, a roller transmission mechanism 54 and a printing roller set 56. The first roller set 50 is disposed within the third paper path 42. The second roller set 52 is disposed within the fourth paper path 44. The printing roller set 56 is disposed within the second paper path 40 and located in a position near the print head 32. The roller transmission mechanism 54 is coupled to the first roller set 50, the second roller set 52 and the printing roller set 56. Furthermore, the first roller set 50 includes a first active roller 501 and a first idle roller 502. The second roller set 52 includes a second active roller 521 and a second idle roller 522. The printing roller set 56 includes a printing active roller 561 and a printing idle roller 562. The first idle roller 502 rotably abuts against the first active roller 501. The second idle roller 522 rotably abuts against the second active roller 521. The printing idle roller 562 rotably abuts against the printing active roller 561.

Figure 5:
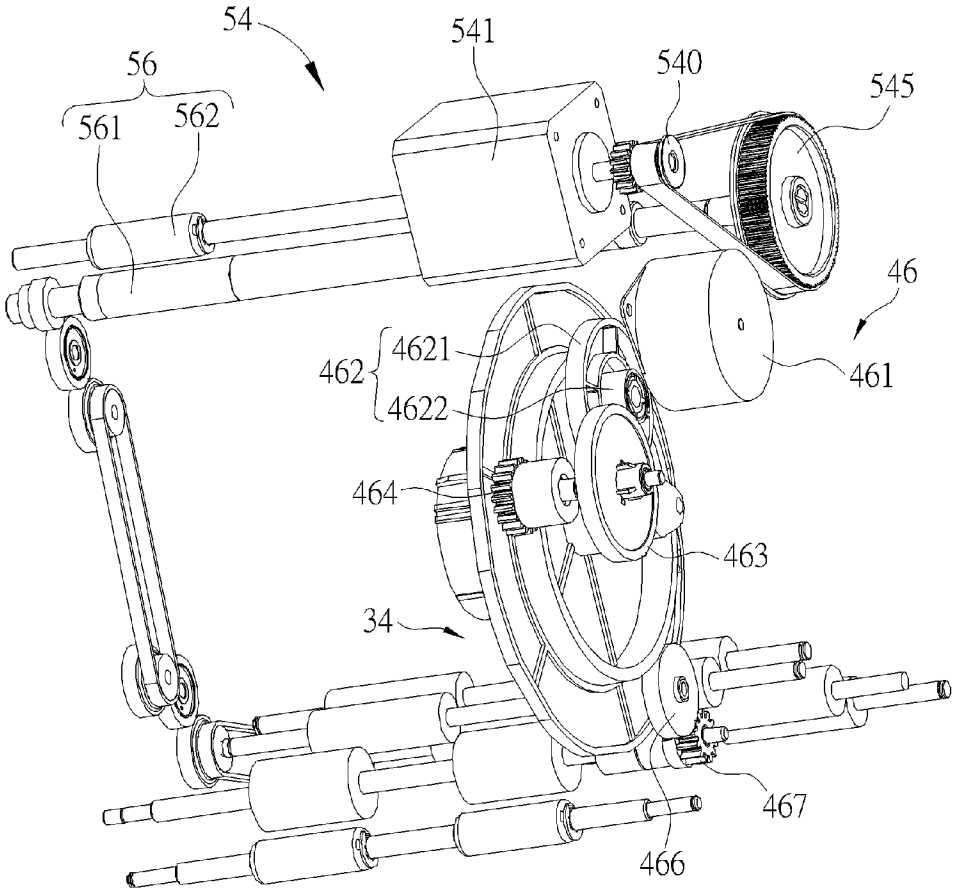
FIG. 5 is an inter transmission diagram of the printing device in another view according to the embodiment of the present invention.
Figure 6:
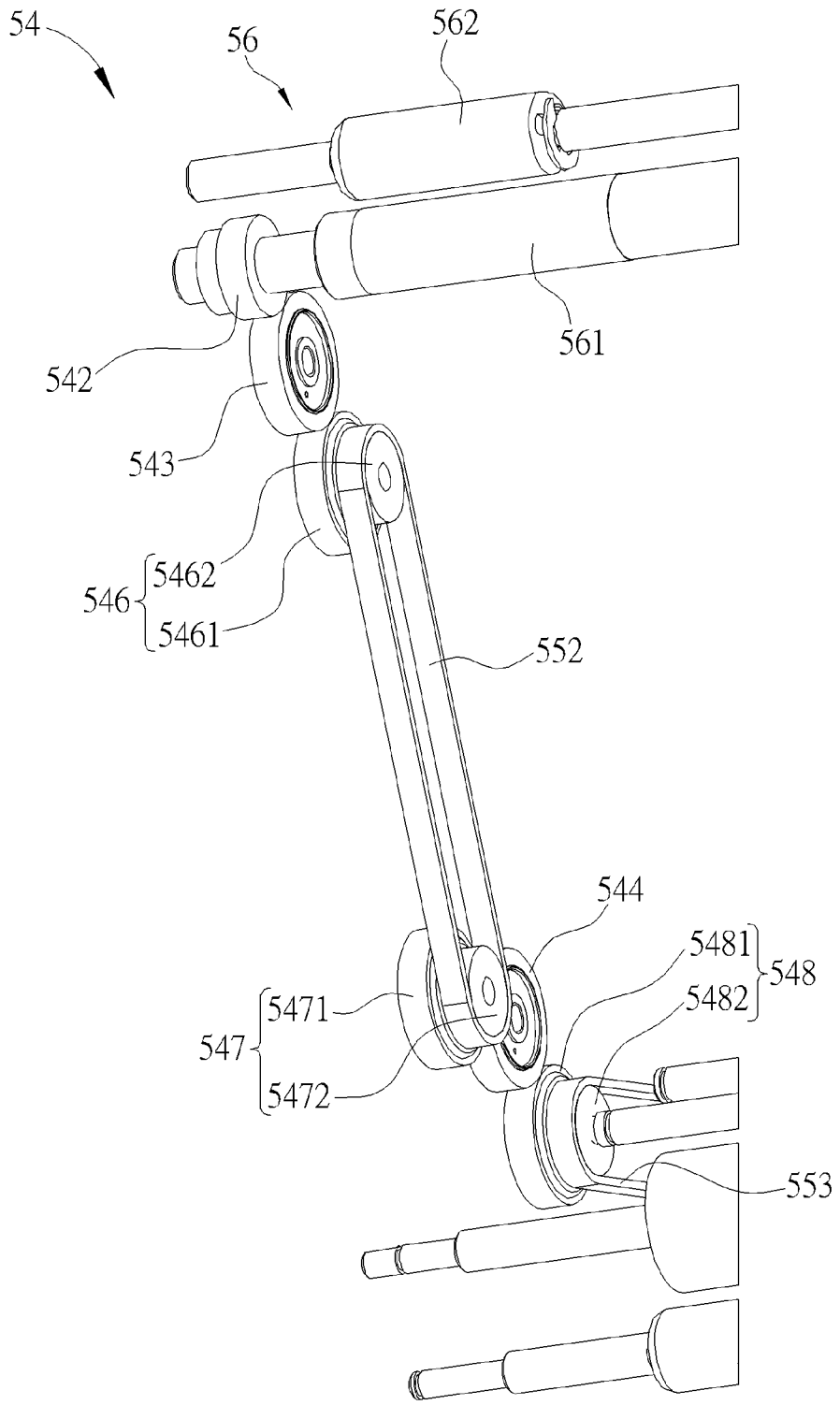
FIG. 6 is a partly diagram of a roller transmission mechanism shown in FIG. 5.

Please refer to FIG. 5 and FIG. 6. FIG. 5 is an inter transmission diagram of the printing device 3 in another view according to the embodiment of the present invention. FIG. 6 is a partly diagram of the roller transmission mechanism 54 shown in FIG. 5. The roller transmission mechanism 54 includes an actuating pulley 540, a second actuating member 541, a seventh gear 542, an eighth gear 543, a ninth gear 544, a pulley 545, a first step wheel 546, a second step wheel 547, a third step wheel 548, a fourth step wheel 549, a first belt 551, a second belt 552 and a third belt 553. The first step wheel 546 has a first gear portion 5461 and a first pulley portion 5462. The second step wheel 547 has a second gear portion 5471 and a second pulley portion 5472. The third step wheel 548 has a third gear portion 5481 and a third pulley portion 5482. The fourth step wheel 549 has a fourth gear portion 5491 and a fourth pulley portion 5492. The actuating pulley 540 is combined with the second actuating member 541. The pulley 545 and the seventh gear 542 are respectively coupled to two sides of the printing active roller 561, as shown in FIG. 3. The second active roller 521 is coupled to the third step wheel 548. The first active roller 501 is combined with the fourth step wheel 549.

Furthermore, the first belt 551 connects the actuating pulley 540 and the pulley 545. The eighth gear 543 engages with the seventh gear 542 and the first gear portion 5461 of the first step wheel 546. The second belt 552 connecting the first pulley portion 5462 of the first step wheel 546 and the second pulley portion 5472 of the second step wheel 547. The ninth gear 544 engages with the second gear portion 5471 of the second step wheel 547 and the third gear portion 5481 of the third step wheel 548. The third belt 553 connects the third pulley portion 5482 of the third step wheel 548 and the fourth pulley portion 5492 of the fourth step wheel 549.

As shown in FIG. 2, when the second actuating member 541 drives the actuating pulley 540 to rotate in the counterclockwise direction CCW, the pulley 545 is activated by the actuating pulley 540 via the first belt 551, so as to rotate in the counterclockwise direction. Since the printing active roller 561 respectively couples with the pulley 545 and the seventh gear 542 (as shown in FIG. 3), the pulley 545 activates the printing active roller 561 and the seventh gear 542 to rotate in the counterclockwise direction simultaneously, and the printing active roller 561 is further capable of activating the printing idle roller 562 to rotate reversely, such that the printing media 36 is moved in the second paper path 40 along a third direction X3.

Furthermore, the third step wheel 548 is capable of activating the fourth pulley portion 5492 of the fourth step wheel 549 via the third belt 553, so as to drive the fourth step wheel 549 to rotate in the counterclockwise direction. Since the first active roller 501 is coupled to the fourth step wheel 549, as shown in FIG. 3, the first active roller 501 activates with the fourth step wheel 549 and rotates in the counterclockwise direction, and the first active roller 501 activates the first idle roller 502 to rotate reversely, such that the printing media 36 is moved in the third paper path 42 along a fifth direction X5. In summary, when the second actuating member 541 drives the actuating pulley 540 to rotate in the counterclockwise direction CCW, the roller transmission mechanism 54 is used for activating the printing active roller 561, the second active roller 521 and the first active roller 501 to rotate simultaneously, so as to move the printing media 36 in a direction approaching the print head 32.

As mentioned above, when the second actuating member 541 drives the actuating pulley 540 to rotate in the clockwise direction CW opposite to the counterclockwise direction CCW, the roller transmission mechanism 54 is used for activating the printing active roller 561, the second active roller 521 and the first active roller 501 to rotate simultaneously, so as to move the printing media 36 in a direction departing from the print head 32. In other words, when the second actuating member 541 drives the actuating pulley 540 to rotate in the clockwise direction CW, the printing active roller 561 activates the printing media 36 to move in the second paper path 40 along a sixth direction X6 opposite to the third direction X3; the second active roller 521 activates the printing media 36 to move in the fourth paper path 44 along a seventh direction X7 opposite to the fourth direction X4; the first active roller 501 activates the printing media 36 to move in the third paper path 42 along an eighth direction X8 opposite to the fifth direction X5.

As shown in FIG. 1, the printing device 3 further includes a cutting mechanism 58, a first guiding gate mechanism 60, a second guiding gate mechanism 62, a first paper head sensor 64, a second paper head sensor 66, a third paper head sensor 68 and a paper end sensor 70. The cutting mechanism 58 is disposed on the third paper path 42 and located between the second paper path 40 and the fourth paper path 44. The cutting mechanism 58 is used for cutting the printing media 36, so as to cut printing media 36 rolled on the paper roll 34 from a roll type into a sheet type, and principles are provided hereinafter. The first guiding gate mechanism 60 is disposed on the second end 383 of the first paper path 38 and for selectively communicating the first paper path 38 with the second paper path 40 or with the third paper path 42. The second guiding gate mechanism 62 is disposed on a conjunction where the third paper path 42 is connected to the fourth paper path 44 and for selectively communicating the third paper path 42 with the fourth paper path 44. The first paper head sensor 64 is disposed within the first paper path 38 and for sensing a paper head 365 of the printing media 36. The second paper head sensor 66 and the third paper head sensor 68 are both disposed within the third paper path 42 and for sensing the paper head 365 of the printing media 36, respectively. The paper end sensor 70 is disposed within the third paper path 42 and located near the second guiding gate mechanism 62.

Figure 7:
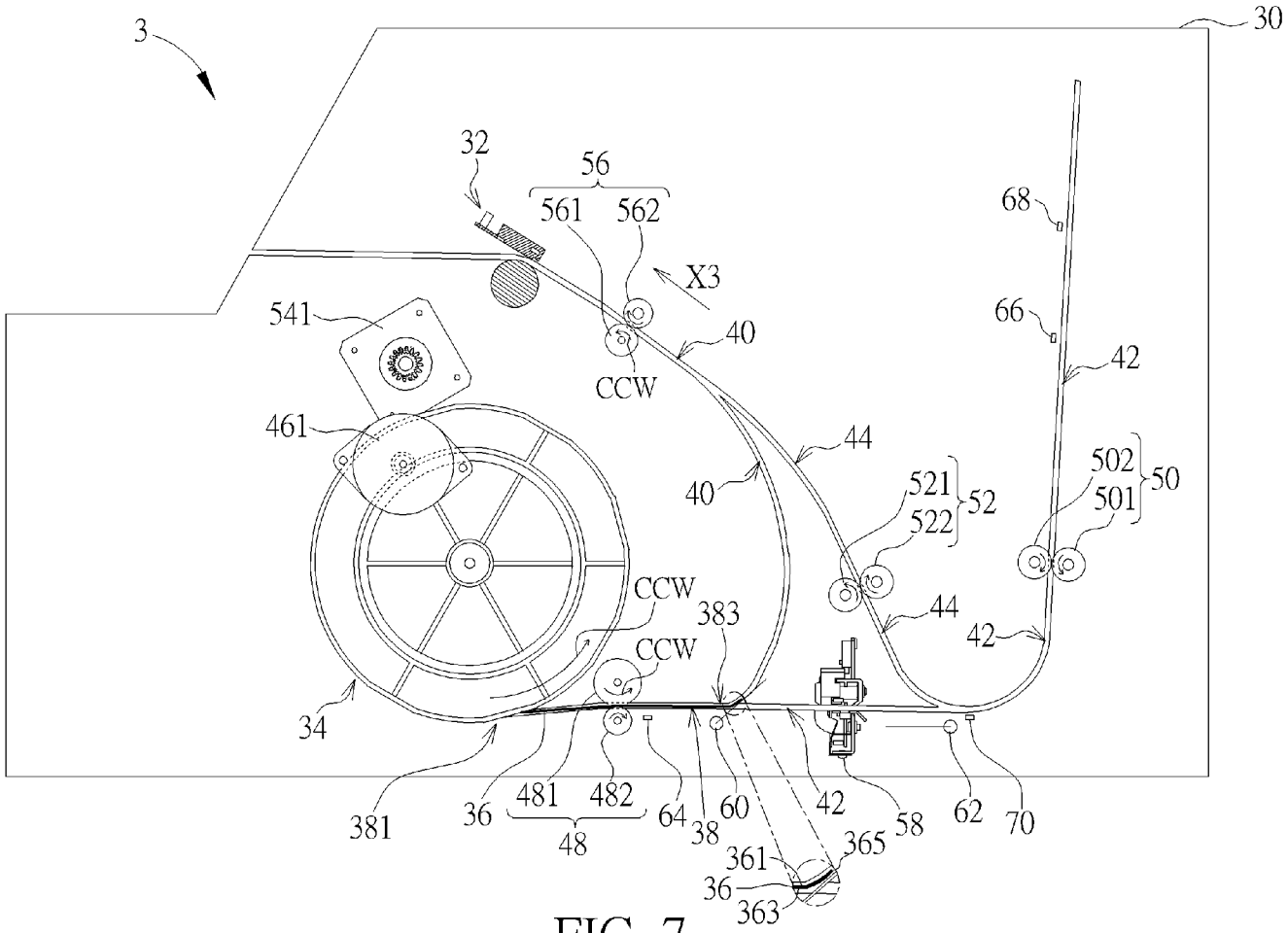
FIG. 7 to FIG. 13 are respectively diagrams of the printing device in different printing statuses according to the embodiment of the present invention.
Figure 8:
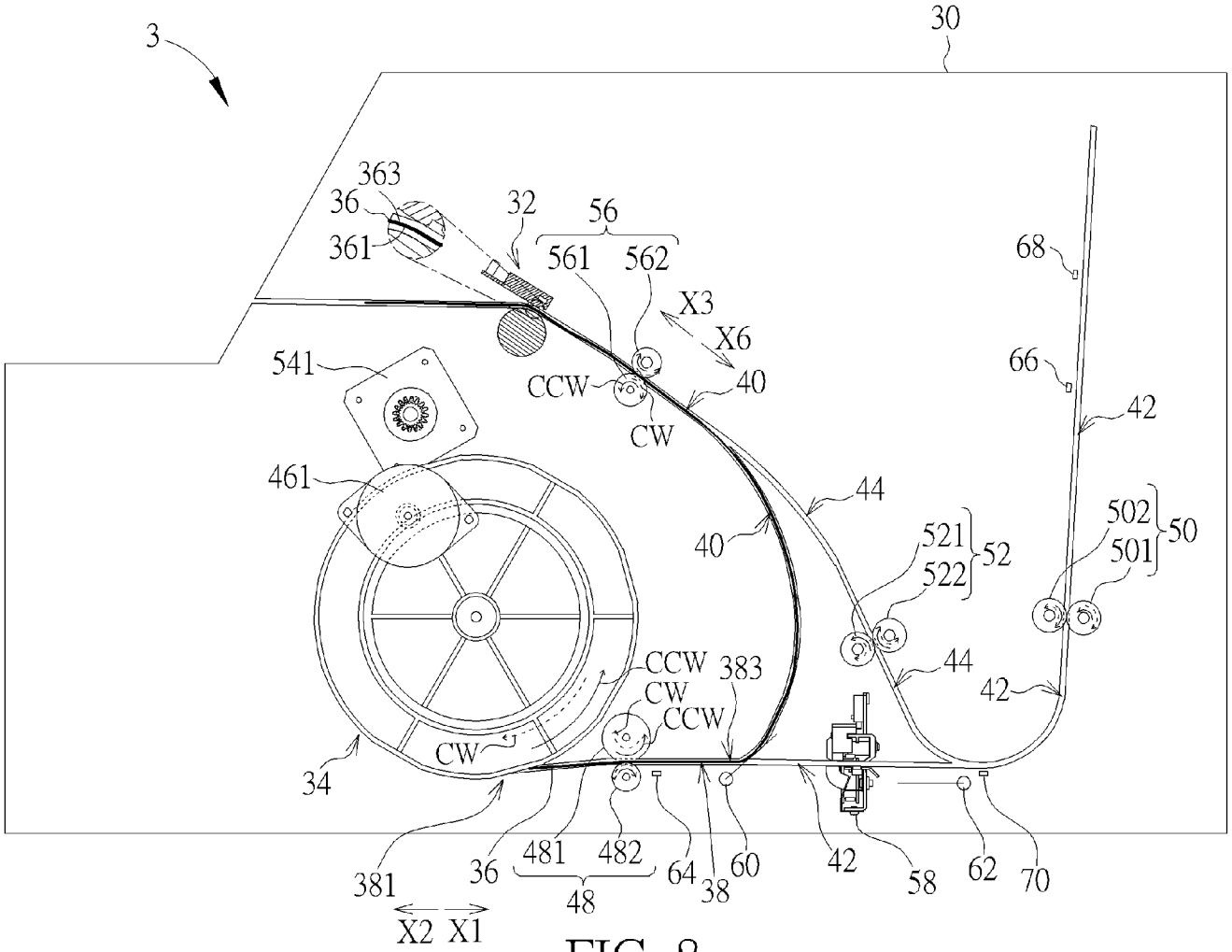

Detailed descriptions for principles of the printing device 3 for duplex printing are provided as follows. Please refer to FIG. 7 to FIG. 13. FIG. 7 to FIG. 13 are respectively diagrams of the printing device 3 in different printing statuses according to the embodiment of the present invention. As shown in FIG. 7, the first guiding gate mechanism 60 is driven to communicate the first paper path 38 with the second paper path 40. Meanwhile, the first actuating member 461 drives the paper roll 34 and the feeding active roller 481 to rotate in the counterclockwise direction CCW, such that the printing media 36 rolled on the paper roll 34 is fed into the first paper path 38 along the first direction X1 and further from the first paper path 38 into the second paper path 40 via the first guiding gate mechanism 60. On the other hand, as shown in FIG. 7 and FIG. 8, the second actuating member 541 drives the printing active roller 561 to rotate in the counterclockwise direction CCW, such that the printing media 36 within the second paper path 40 is fed to the print head 32 for printing along the third direction X3.

Since the second paper path 40 is extended reverse to the first paper path 38 for being connected to the print head 32, the second paper path 40 is able to turn the bottom surface 363 of the printing media 36 to face the print head 32 when the printing media 36 is fed to the print head 32 via the second paper path 40. In such a manner, when the printing media 36 is fed to the print head 32 via the first paper path 38 and the second paper path 40, the print head 32 is able to perform printing operation on the bottom surface 363 of the printing media 36.

As shown in FIG. 8, when the bottom surface 363 of the printing media 36 has been printed by the print head 32, the second actuating member 541 drives the printing active roller 561 to rotate in the clockwise direction CW, so as to feed the printing media 36 out of the second paper path 40 along the sixth direction X6 opposite to the third direction X3; the first actuating member 461 drives the paper roll 34 and the feeding active roller 481 to rotate in the clockwise direction CW, so as to feed the printing media 36 out of the first paper path 38 along the second direction X2 opposite to the first direction X1. When the printing media 36 is moved to a position shown in FIG. 9 within the first paper path 38 along the second direction X2, the first paper head sensor 64 senses the paper head 365 of the printing media 36, such that the first guiding gate mechanism 60 is driven to communicate the first paper path 38 with the third paper path 42.

Figure 9:
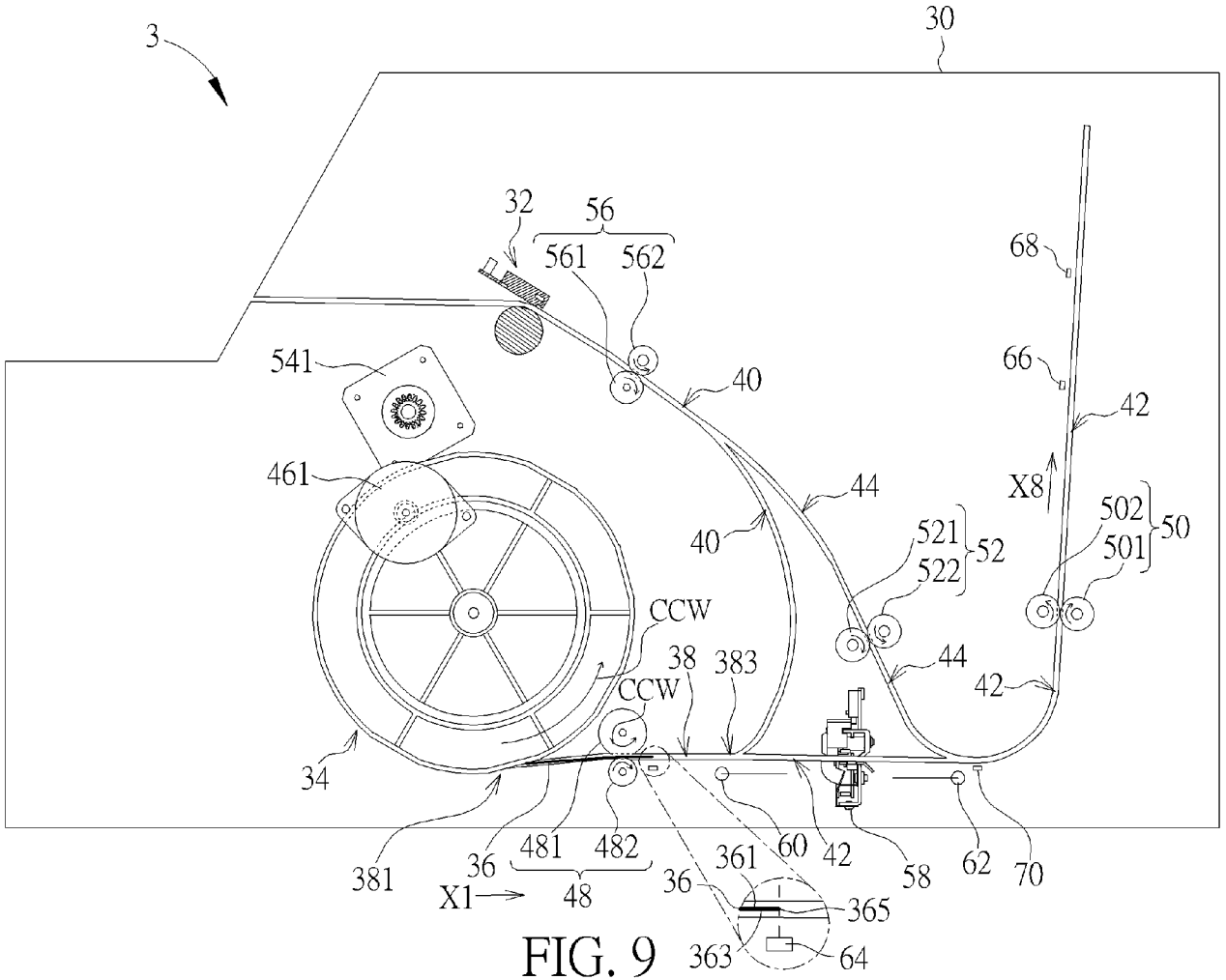

Afterwards, the first actuating member 461 drives the paper roll 34 and the feeding active roller 481 to rotate in the counterclockwise direction CCW again, such that the printing media 36 rolled on the paper roll 34 is fed into the first paper path 38 along the first direction X1 and further guided by the first guiding gate mechanism 60 from the first paper path 38 into the third paper path 42. On the other hand, as shown in FIG. 9, the second actuating member 541 drives the first active roller 501 to rotate in the clockwise direction CW, so as to move the printing media 36 within the third paper path 42 along the eighth direction X8. When the printing media 36 is moved within the third paper path 42 to a position shown in FIG. 10 along the eighth direction X8, the second paper head sensor 66 senses the paper head 365 of the printing media 36, such that the cutting mechanism 58 is driven to cut the printing media 36 into a printing sheet 36', as shown in FIG. 11.

Figure 10:
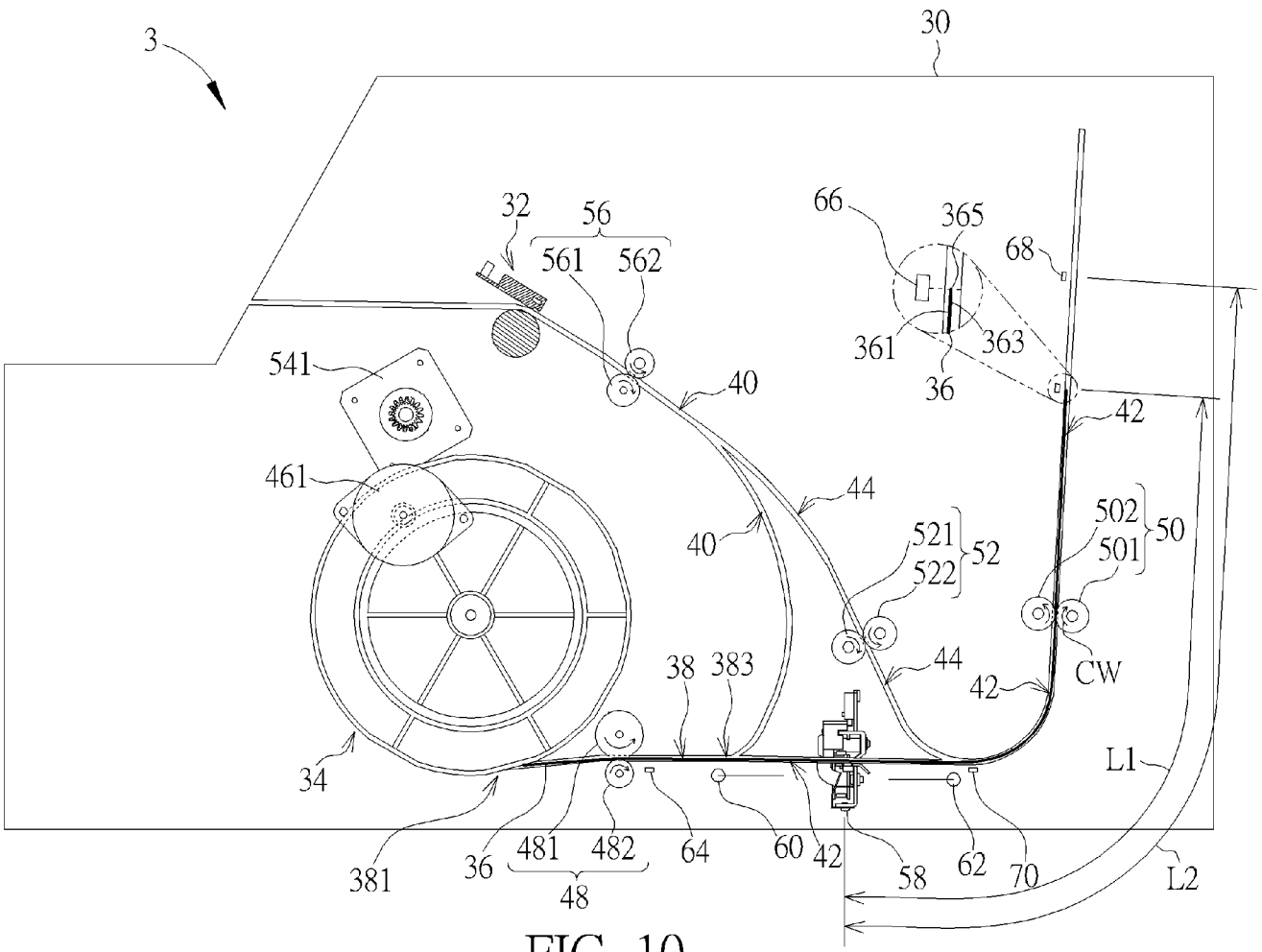
Figure 11:
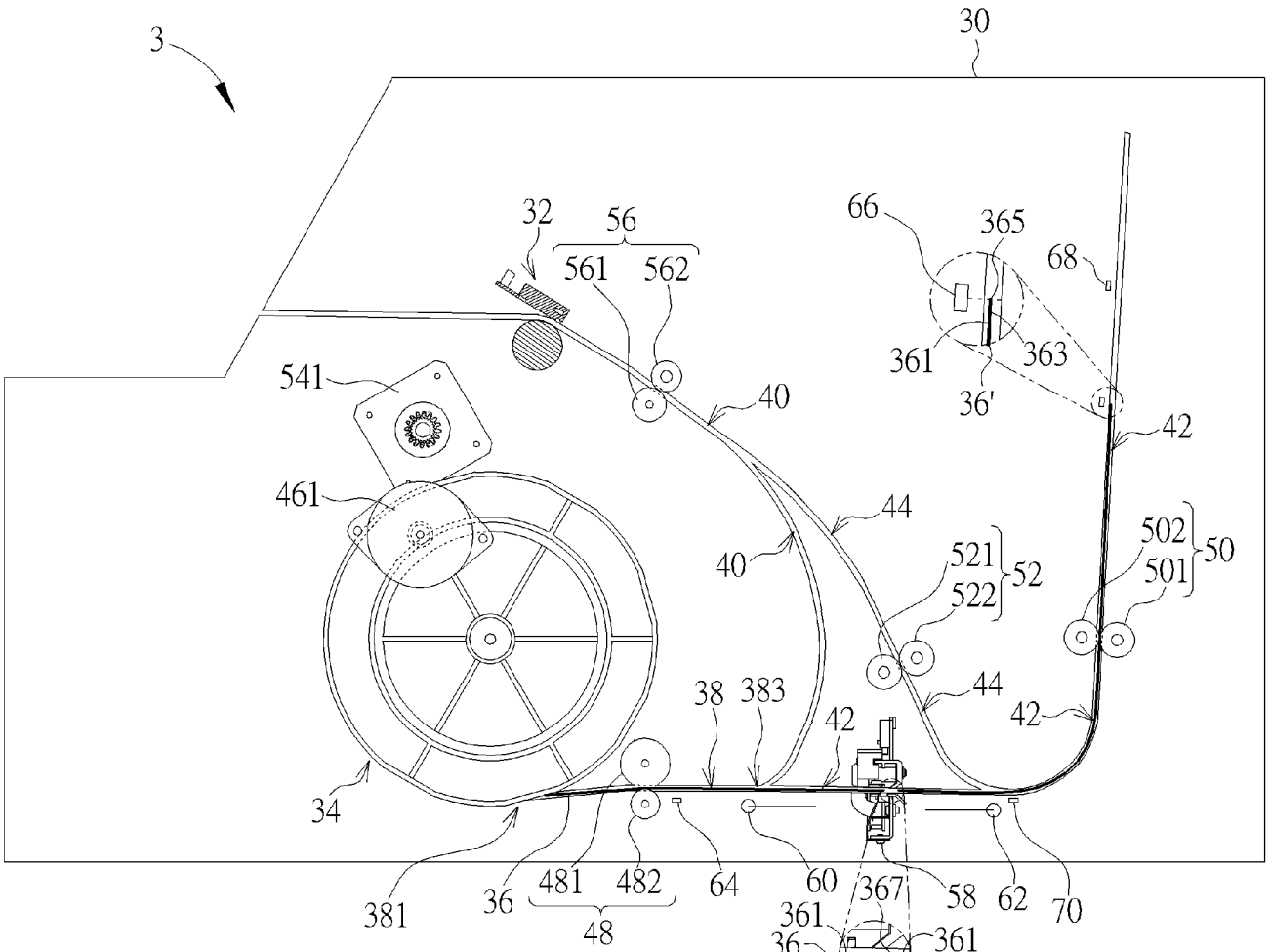

As shown in FIG. 10, a path length of the third paper path 42 between the second paper head sensor 66 and the cutting mechanism 58 is substantially equal to a first paper length L1. When the second paper head sensor 66 senses the paper head 365 of the printing media 36 to enable the cutting mechanism 58 to cut the printing media 36 into the printing sheet 36', the paper length of the printing sheet 36' is substantially equal to the first paper length L1. In other words, by utilizing the structure that the path length of the third paper path 42 between the second paper head sensor 66 and the cutting mechanism 58 is substantially equal to the first paper length L1, the cutting mechanism 58 is capable of forming the printing sheet 36' with the paper length substantially equal to the first paper length L1. In this embodiment, the cutting mechanism 58 can be designed to cut the printing media 36 when the third paper head sensor 68 senses the paper head 365 of the printing media 36, wherein a path length of the third paper path 42 between the third paper head sensor 68 and the cutting mechanism 58 is substantially equal to a second paper length L2. When the third paper head sensor 68 senses the paper head 365 of the printing media 36 to enable the cutting mechanism 58 to cut the printing media 36 into the printing sheet 36', the paper length of the printing sheet 36' is substantially equal to the second paper length L2. As shown in FIG. 10, the second paper length L2 is greater than the first paper length L1.

Figure 12:
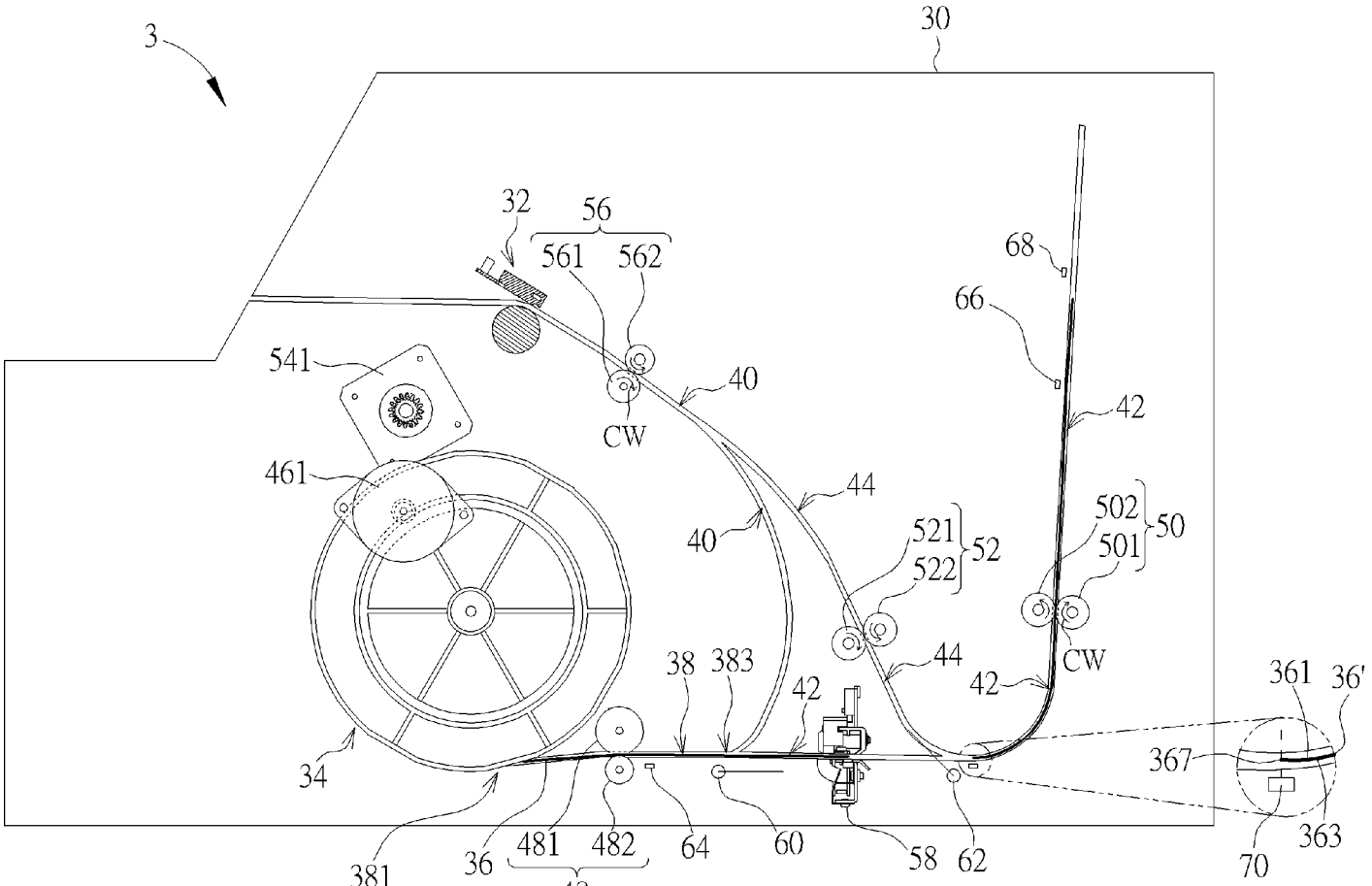
Figure 13:
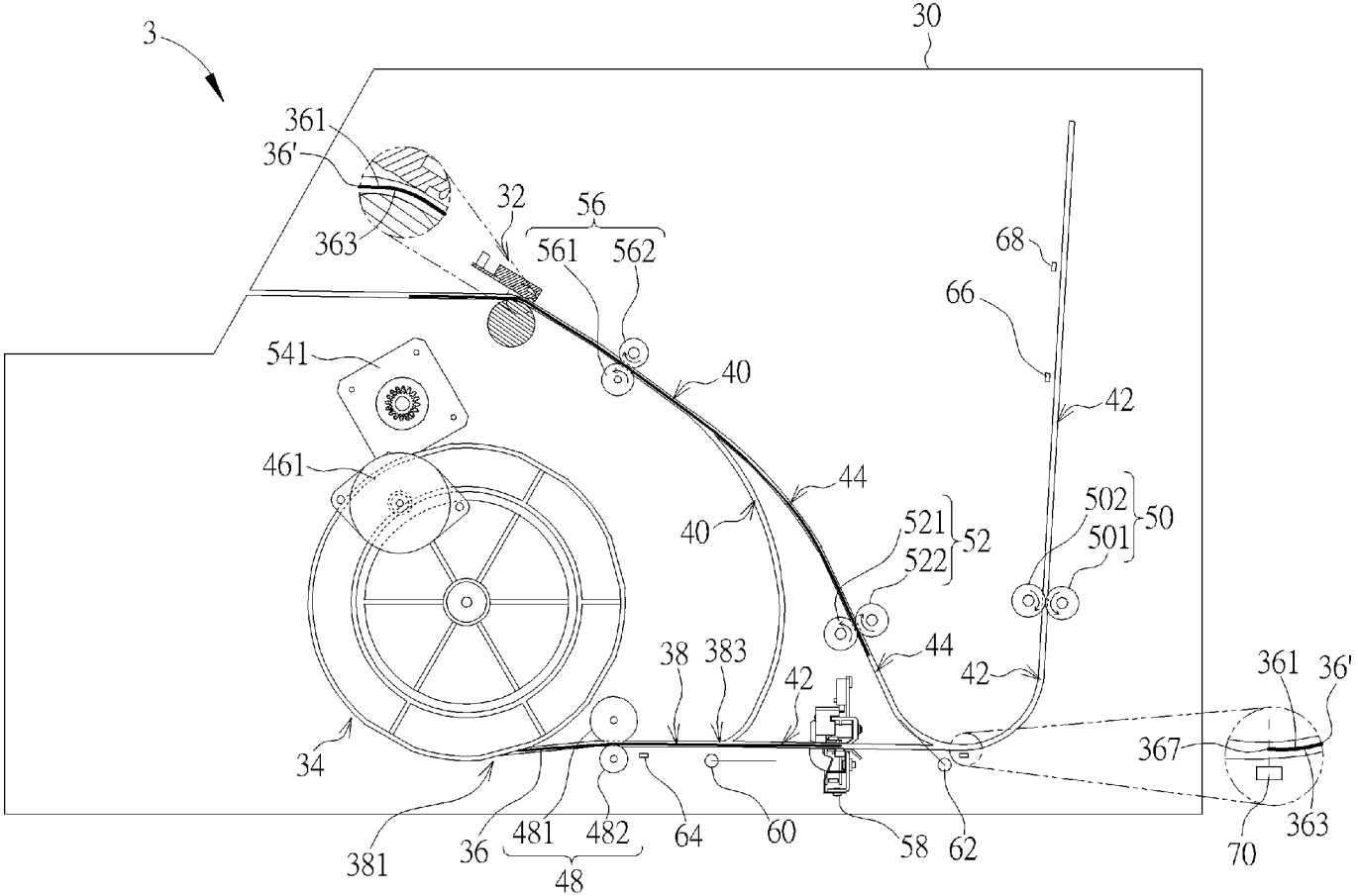

When the cutting mechanism 58 cuts the printing media 36 into the printing sheet 36', the first actuating member 461 stops for staying the printing media 36, and the second actuating member 541 drives the first active roller 501 to rotate in the clockwise direction CW continuously, so as to move the printing sheet 36' to a position shown in FIG. 12 along the eighth direction X8. Meanwhile, the paper end sensor 70 senses a paper end 367 opposite to the paper head 365 of the printing sheet 36'. When the paper end sensor 70 senses the paper end 367 of the printing sheet 36', the second guiding gate mechanism 62 is driven to communicate the fourth paper path 44 in advance. Then, the second actuating member 541 drives the first active roller 501 to rotate in the counterclockwise direction CCW, such that the printing sheet 36' is moved within the third paper path 42 along the eighth direction X8 continuously and further guided into the fourth paper path 44 by the second guiding gate mechanism 62.

Furthermore, the second actuating member 541 simultaneously drives the second active roller 521 to rotate in the counterclockwise direction CCW, so as to feed the printing sheet 36' from the fourth paper path 44 to the second paper path 40. The second actuating member 541 further drives the printing active roller 561 to rotate in the counterclockwise direction CCW simultaneously, so as to feed the printing sheet 36' to the print head 32 for printing. During the above-mentioned feeding process, the third paper path 42, the fourth paper path 44 and the second paper path 40 do not turn the printing sheet 36' over. Accordingly, the top surface 361 of the printing sheet 36' faces the print head 32 during the above-mentioned process. In such a manner, when the printing sheet 36' is fed to the print head 32 via the third paper path 42, the fourth paper path 44 and the second paper path 40, the print head 32 is able to perform printing operation on the top surface 361 of the printing media 36.

Compared to the prior art, the present invention utilizes the second paper path to turn the bottom surface of the printing media to face the print head when the printing media is fed, such that the print head is able to perform printing operation on the bottom surface of the printing media. The present invention further utilizes the cutting mechanism to cut the printing media within the third paper path into the printing sheet. Then, the printing sheet is fed into the second paper path via the fourth paper path, and further fed to the print head via the second paper path, such that the print head is able to perform printing operation on the top surface of the printing sheet. In such a manner, the present invention can perform duplex printing operation, so as to decrease labor time and enhance convenience in operation.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A printing device with duplex printing function, comprising:

a print head;

a paper roll for rolling a printing media;

a first paper path having a first end and a second end, the first end being connected to the paper roll;

a second paper path connected to the second end of the first paper path and oriented reverse to the first paper path for being connected to the print head, the second paper path being for turning a bottom surface of the printing media to face the print head when the printing media is fed to the print head via the first paper path and the second paper path;

a third paper path extending from the second end of the first paper path;

a cutting mechanism disposed on the third paper path, the cutting mechanism being for cutting the printing media into a printing sheet when the printing media is fed into the third paper path via the first paper path; and a fourth paper path connecting the third paper path and the second paper path, such that the printing sheet is fed from the third paper path into the second paper path via the fourth paper path, so as to be fed to the print head with a top surface opposite to the bottom surface of the printing sheet facing the print head.

2. The printing device of claim 1, further comprising:

a feeding mechanism coupled to the paper roll, the feeding mechanism being for driving the paper roll to rotate, so as to feed the printing media into the first paper path along a first direction or to feed the printing media out of the first paper path along a second direction opposite to the first direction.

3. The printing device of claim 2, wherein the feeding mechanism comprises:

a first actuating member;

an actuating gear combined with the first actuating member;

a first gear having a first tooth portion and a second tooth portion, the first tooth portion engaging with the actuating gear;

a second gear engaging with the second tooth portion;

a third gear coupled to the second gear;

a fourth gear combined with the paper roll and engaging with the third gear;

a fifth gear engaging with the fourth gear; and a sixth gear engaging with the fifth gear.

4. The printing device of claim 2, further comprising:

a feeding roller set coupled to the feeding mechanism and for moving the printing media along the first direction or along the second direction.

5. The printing device of claim 4, wherein the feeding roller set comprises:

a feeding active roller; and a feeding idle roller rotably abutting against the feeding active roller, the feeding active roller and the feeding idle roller being cooperatively for moving the printing media.

6. The printing device of claim 1, further comprising:
a first guiding gate mechanism disposed on the second end of the first paper path and for selectively communicating the first paper path with the second paper path or with the third paper path.

7. The printing device of claim 6, further comprising:
a second guiding gate mechanism disposed on a conjunction where the third paper path is connected to the fourth paper path and for selectively communicating the third paper path with the fourth paper path.

8. The printing device of claim 1, further comprising:
a first paper head sensor disposed within the first paper path and for sensing a paper head of the printing media.

9. The printing device of claim 8, further comprising:
a second paper head sensor disposed within the third paper path and for sensing the paper head of the printing media, wherein a path length of the third paper path between the second paper head sensor and the cutting mechanism is substantially equal to a first paper length.

10. The printing device of claim 9, further comprising:
a third paper head sensor disposed within the third paper path and for sensing the paper head of the printing media, wherein a path length of the third paper path between the third paper head sensor and the cutting mechanism is substantially equal to a second paper length, and the second paper length is greater than the first paper length.

11. The printing device of claim 8, further comprising:
a paper end sensor disposed within the third paper path and for sensing a paper end opposite to the paper head of the printing sheet.

12. The printing device of claim 1, further comprising:
a first roller set disposed within the third paper path and for moving the printing media or the printing sheet along the third paper path.

13. The printing device of claim 12, wherein the first roller set comprises:
a first active roller; and
a first idle roller rotably abutting against the first active roller, the first active roller and the first idle roller being cooperatively for moving the printing media or the printing sheet.

14. The printing device of claim 13, further comprising:
a second roller set disposed within the fourth paper path and for moving the printing sheet along the fourth paper path.

15. The printing device of claim 14, wherein the second roller set comprises:
a second active roller; and
a second idle roller rotably abutting against the second active roller, the second active roller and the second idle roller being cooperatively for moving the printing media or the printing sheet.

16. The printing device of claim 15, further comprising:
a roller transmission mechanism coupled to the first roller set and the second roller set, the roller transmission mechanism being for driving the first roller set and the second roller set to rotate.

17. The printing device of claim 16, wherein the roller transmission mechanism comprises:
a second actuating member;
an actuating pulley combined with the second actuating member;
a first step wheel having a first gear portion and a first pulley portion;
a second step wheel having a second gear portion and a second pulley portion;
a third step wheel coupled to the second active roller, the third step wheel having a third gear portion and a third pulley portion;
a fourth step wheel having a fourth gear portion and a fourth pulley portion;
a seventh gear;
an eighth gear engaging with the seventh gear and the first gear portion;
a ninth gear engaging with the second gear portion of the second step wheel and the third gear portion of the third step wheel;
a pulley;
a first belt connecting the actuating pulley and the pulley;
a second belt connecting the first pulley portion of the first step wheel and the second pulley portion of the second step wheel; and
a third belt connecting the third pulley portion of the third step wheel and the fourth pulley portion of the fourth step wheel.

18. The printing device of claim 16, further comprising:
a printing roller set coupled to the roller transmission mechanism and for moving the printing media or the printing sheet to the print head.

19. The printing device of claim 18, wherein the printing roller set comprises:
a printing active roller; and
a printing idle roller rotably abutting against the printing active roller, the printing active roller and the printing idle roller being cooperatively for moving the printing media or the printing sheet.

20. The printing device of claim 1, further comprising:
a printing roller set disposed within the second paper path and located in a position near the print head, the printing roller set being for moving the printing media or the printing sheet to the print head.

* * * * *